US008619105B2

(12) United States Patent
Eoka

(10) Patent No.: US 8,619,105 B2
(45) Date of Patent: Dec. 31, 2013

(54) IMAGE FORMING APPARATUS AND METHOD OF ADJUSTING HEAD PRESSURIZING FORCE

(75) Inventor: Kenji Eoka, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 32 days.

(21) Appl. No.: 13/406,889

(22) Filed: Feb. 28, 2012

(65) Prior Publication Data

US 2012/0218369 A1 Aug. 30, 2012

(30) Foreign Application Priority Data

Feb. 28, 2011 (JP) ..... 2011-42085

(51) Int. Cl.
*B41J 25/304* (2006.01)

(52) U.S. Cl.
USPC ..... 347/198

(58) Field of Classification Search
USPC ..... 347/197, 198; 400/120.16, 120.17, 82, 400/188
See application file for complete search history.

(56) References Cited

U.S. PATENT DOCUMENTS

| | | | |
|---|---|---|---|
| 2008/0003038 | A1 | 1/2008 | Nihashi et al. |
| 2008/0003039 | A1 | 1/2008 | Sekino et al. |
| 2008/0003041 | A1 | 1/2008 | Sekino et al. |
| 2011/0293347 | A1 | 12/2011 | Sekino et al. |

FOREIGN PATENT DOCUMENTS

| | | | |
|---|---|---|---|
| JP | 62-227770 | * 10/1987 | ..... B41J 3/20 |
| JP | 4-294180 | * 10/1992 | ..... B41J 25/304 |
| JP | 08-300697 | 11/1996 | |
| JP | 09-123567 | 5/1997 | |
| JP | 10-076713 | 3/1998 | |
| JP | 2000-272151 | 10/2000 | |
| JP | 2005-350218 | 12/2005 | |
| JP | 2010-228324 | 10/2010 | |
| JP | 2010-272151 | 12/2010 | |

OTHER PUBLICATIONS

Notification of Reasons for Refusal for Patent Application No. 2011-042085 Dated Mar. 19, 2013, 9 pgs.

* cited by examiner

*Primary Examiner* — Huan Tran
(74) *Attorney, Agent, or Firm* — Turocy & Watson, LLP

(57) ABSTRACT

First and second sensors are disposed downstream and upstream of a conveyance path, respectively. A first head is disposed between the first sensor and the second sensor opposite to a first platen with the conveyance path interposed between the first head and the first platen. The first head pressurizing force adjusting device adjusts a pressurizing force of the first head to the first platen. A second head is disposed between the first head and the second sensor opposite to a second platen with the conveyance path interposed between the second head and the second platen. The second head pressurizing force adjusting device adjusts a pressurizing force of the second head to the second platen. The control unit controls the second head pressurizing force adjusting device to separate the second head from the second platen if a tailing end of the recording medium escapes from the second sensor.

12 Claims, 9 Drawing Sheets

IMAGE FORMING APPARATUS AND METHOD OF ADJUSTING HEAD PRESSURIZING FORCE

CROSS-REFERENCE TO RELATED APPLICATION

This application is based upon and claims the benefit of priority from Japanese Patent Application No. 2011-042085, filed on Feb. 28, 2011, the entire contents of which are incorporated herein by reference.

FIELD

Embodiments described herein relate to an image forming apparatus and a method of adjusting a head pressurizing force.

BACKGROUND

There are some types of image forming apparatuses for continuously printing both sides of a recording medium, including opposing printing heads with a recording medium conveyance path interposed therebetween.

Such types of image forming apparatuses generally include thermal heads disposed in the vicinity of upstream and downstream in a recording medium conveyance direction. The thermal heads are disposed opposite to a platen with the recording medium conveyance path interposed therebetween. The recording medium is conveyed by rotation of the platen. The conveyance of the recording medium requires rotating the platen with the thermal heads pressurized to the platen.

However, when an image is to be formed near a tailing end of the recording medium, if the thermal head located upstream in the recording medium conveyance direction continues to be pressurized to the platen even when the tailing end of the recording medium is escaped from the thermal head, then the thermal head may be worn out by contact with the platen.

In this regard, there has been proposed a technique to adjust a pressurizing force of a head using a cam.

However, two sets of thermal heads and platens require a more complicated control.

Accordingly, there is a need of an image forming apparatus and a head pressurizing force adjusting method, which can change a pressurizing force of thermal heads depending on a position of a tailing end of a recording medium.

DETAILED DESCRIPTION

According to one embodiment, an image forming apparatus includes a first sensor, a second sensor, a first head, a first head pressurizing force adjusting device, a second head, a second head pressurizing force adjusting device, and a control unit. The first sensor is disposed downstream of a recording medium conveyance path and detects a recording medium. Further, the second sensor is disposed upstream of the recording medium conveyance path and detects the recording medium. The first head is disposed between the first sensor and the second sensor opposite to a first platen with the recording medium conveyance path interposed between the first head and the first platen and forms an image on a first surface of the recording medium. The first head pressurizing force adjusting device adjusts a pressurizing force of the first head to the first platen. The second head is disposed between the first head and the second sensor opposite to a second platen with the recording medium conveyance path interposed between the second head and the second platen and forms an image on a second surface of the recording medium. The second head pressurizing force adjusting device adjusts a pressurizing force of the second head to the second platen. The control unit controls the second head pressurizing force adjusting device to separate the second head from the second platen if a tailing end of the recording medium escapes from the second sensor.

Embodiments of an image forming apparatus and a head pressurizing force adjusting method will now be described in detail with reference to the drawings.

Figure 1:
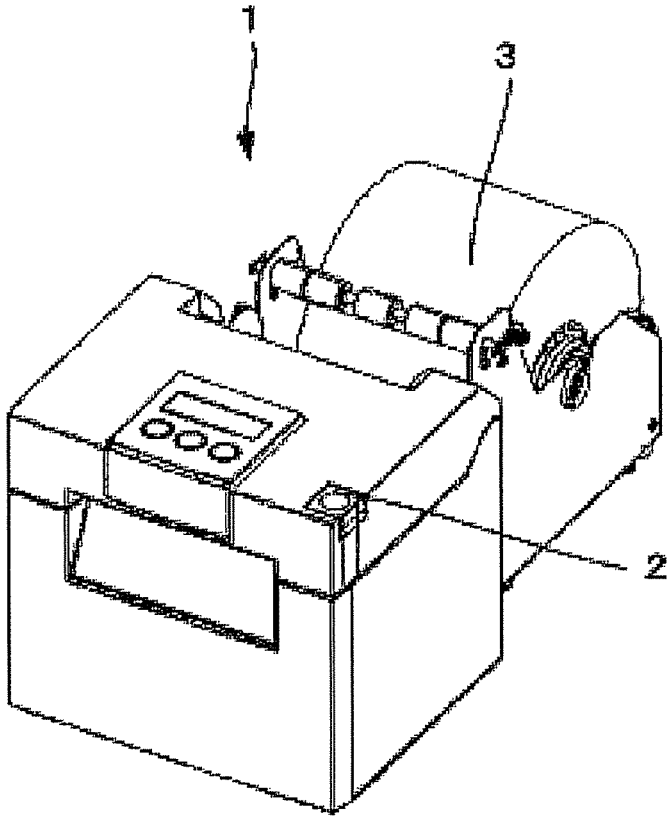
FIG. 1 is a perspective view of an image forming apparatus.

FIG. 1 is a perspective view of an image forming apparatus 1 including a head pressurizing force adjusting device according to an embodiment of the present invention. As shown in FIG. 1, the image forming apparatus 1 has an open key 2. When the open key 2 is pressed, the image forming apparatus 1 discharges a recording medium 3 from the apparatus.

Figure 2:
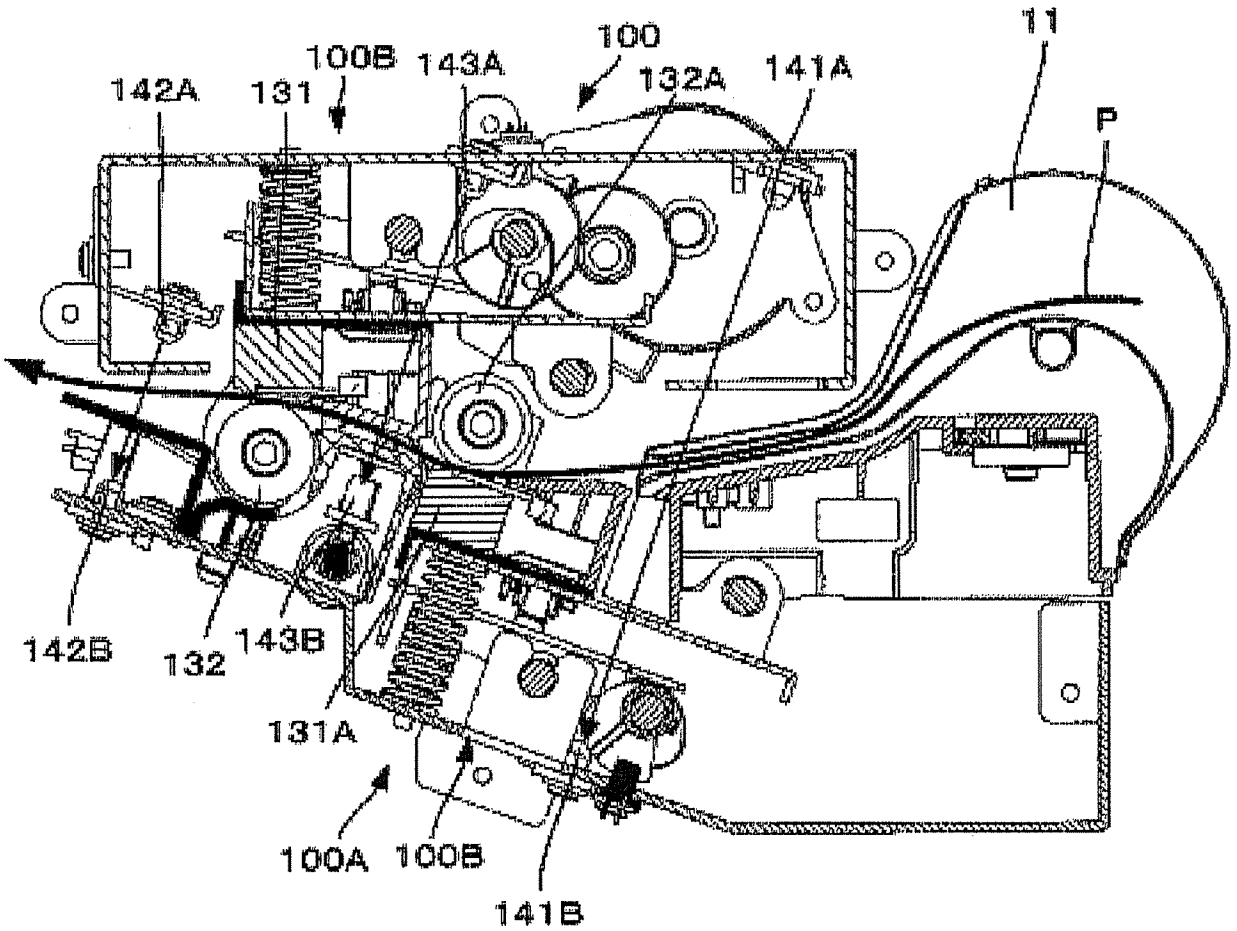
FIG. 2 is a side view of the image forming apparatus.

FIG. 2 is a side view of the image forming apparatus 1. As shown in FIG. 2, the image forming apparatus 1 includes a recording medium conveyance guide 11 and first and second printing devices 100 and 100A, which oppose each other with a recording medium conveyance path P interposed therebetween.

In the image forming apparatus 1, the first printing device 100 is disposed downstream in a recording medium conveyance direction and the second printing device 100A is disposed upstream in the recording medium conveyance direction. The first printing device 100 forms an image on a front surface of the recording medium 3 and the second printing device 100A forms an image on a back surface of the recording medium 3.

The image forming apparatus 1 further includes: a light emitting device 141A and a paper end sensor 141B for detecting the recording medium 3 upstream in the recording medium conveyance direction of the second printing device 100A; a light emitting device 143A and a transmission/reflection type sensor 143B between the first and second printing devices 100 and 100A; and a light emitting device 142A and a discharge sensor 142B for detecting the recording medium 3 downstream in the recording medium conveyance direction of the second printing device 100A.

In the following description, the paper end sensor 141B as a second sensor is referred to as a PE sensor 141B, the transmission/reflection type sensor 143B as a third sensor is referred to as an BD/LG sensor 143B, and the discharge sensor 142B as a first sensor is referred to as an EXIT sensor 142B.

The BD/LG sensor 143B includes an LG sensor, which detects a label attached to the recording medium 3 by detecting an intensity of transmission light of the recording medium 3, and a reflection type BD sensor that detects a black mark indicating a printing start position on the recording medium 3.

The PE sensor 141B and the EXIT sensor 142B is turned ON when the recording medium 3 is detected, while being turned OFF when no recording medium 3 is detected.

The LG sensor is turned ON when the label is detected, while being turned OFF when no label is detected. The BD sensor is turned ON when the black mark is detected, while being turned OFF when no black mark is detected.

The first printing device 100 has the same configuration as the second printing device 100A. As such, only the first printing device 100 will be shown for the purpose of brevity.

The first printing device 100 includes a head 131 such as a thermal head for forming an image and a platen 132 opposed to the head 131 with the recording medium conveyance path P interposed therebetween. Moreover, the first printing device 100 further includes a head pressurizing force adjusting mechanism 100B, which adjusts a pressurizing force of the head 131 to the platen 132.

Figure 3:
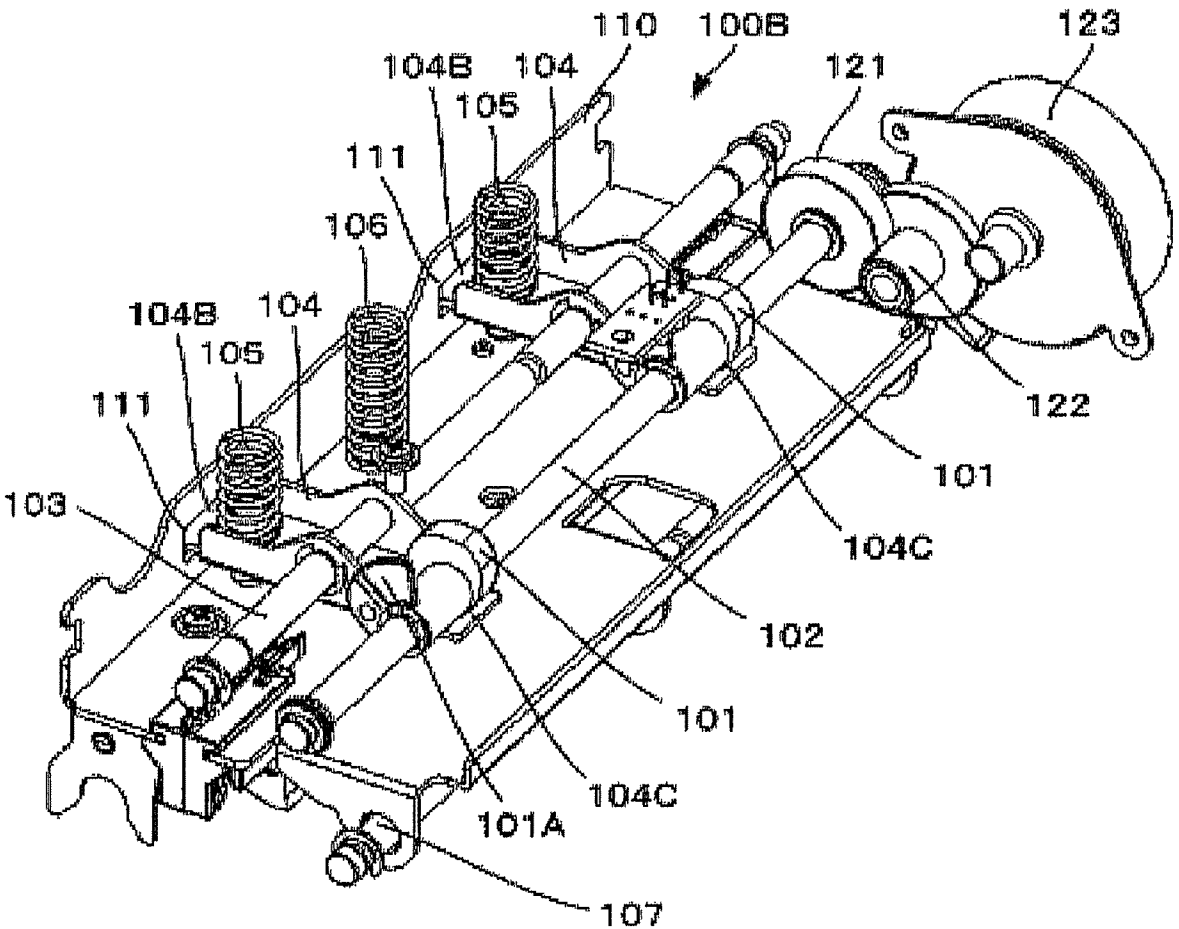
FIG. 3 is a perspective view of a head pressurizing force adjusting mechanism.

FIG. 3 is a perspective view of the head pressurizing force adjusting mechanism 100B. As shown in FIG. 3, the head pressurizing force adjusting mechanism 100B includes: a cam shaft 102 including a pair of first cams 101 and a light shield plate 101A for detection of a home position; a pair of head upper/lower arms 104 pressed by the first cams 101 to be rotated around an arm shaft 103; a pair of first elastic springs 105 that bias the head upper/lower arms 104 toward the platen 132; a head support member 110 that is rotated around a stay shaft 107 and presses the head 131 toward the platen 132; a second elastic spring 106 that biases the head support member 110 toward the platen 132; and a cam gear 121, a speed reduction gear 122 and a first cam motor 123, which rotate the cam shaft 102.

In the following description, a cam of the second printing device is referred to as a second cam and a cam motor thereof is referred to as a second cam motor.

The head upper/lower arms 104 bias the head support member 110 toward the platen 132 by virtue of the first springs 105.

The cross section of the head support member 110 has an L-like shape. The head support member 110 includes an opening 111 in its bent portion. A leading end 104B of the head upper/lower arms 104 is inserted in the opening 111. A tailing end 104C of the head upper/lower arms 104 makes contact with the first cams 101.

Figure 4:
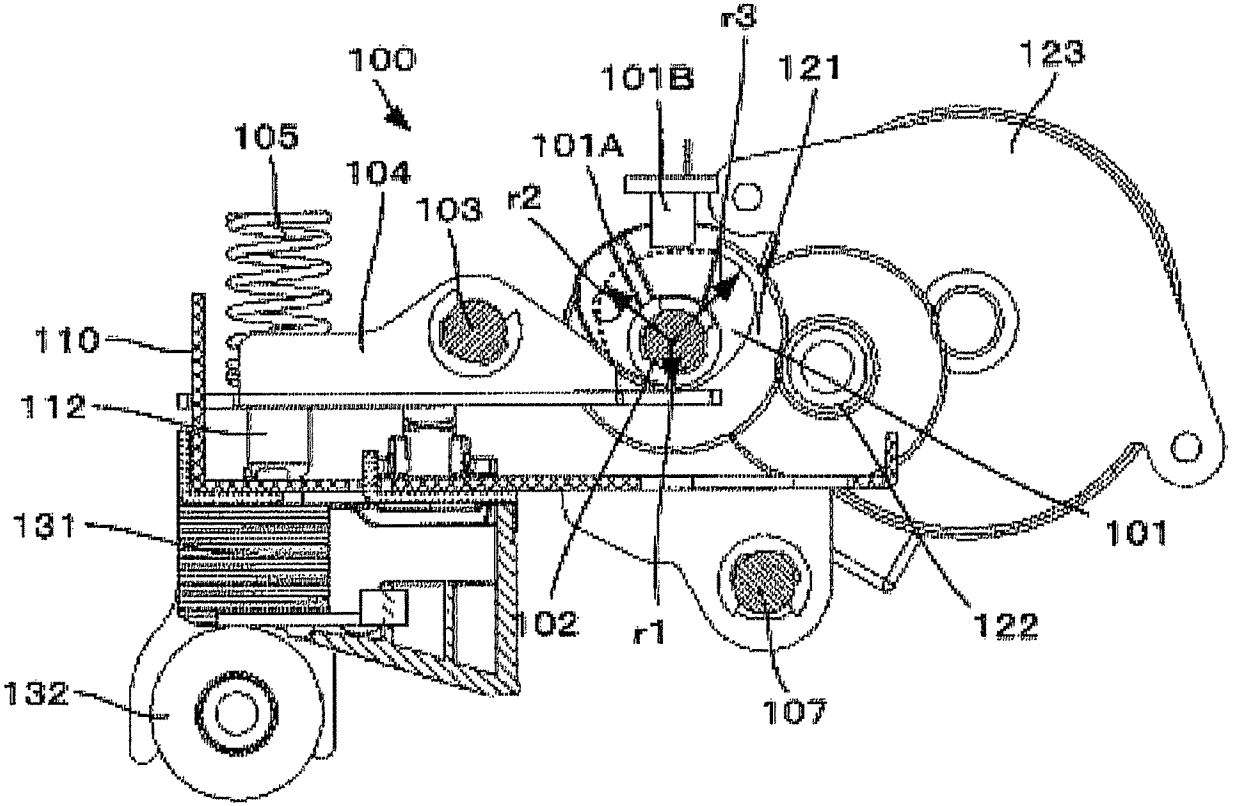
FIG. 4 is a side sectional view of the head pressurizing force adjusting mechanism.

FIG. 4 is a side sectional view of the head pressurizing force adjusting mechanism 100B. As shown in FIG. 4, the head pressurizing force adjusting mechanism 100B includes a home position sensor 101B for detecting a home position of the first cams 101.

The first cams 101 of the head pressurizing force adjusting mechanism 100B have 3 different radiuses.

In the following description, the shortest radius of the first cams 101 is referred to as r1, a position of the first cams 101 at which a position of r1 makes contact with the head upper/lower arms 104 is referred to as position I (not shown), the longest radius of the first cams 101 is referred to as r3, a position of the first cams 101 at which a position of r3 makes contact with the head upper/lower arms 104 is referred to as position III (not shown), an intermediate radius between r1 and r3 of the first cams 101 is referred to as r2, and a position of the first cams 101 at which a position of r2 makes contact with the head upper/lower arms 104 is referred to as position II (not shown).

In the image forming apparatus 1, when the light shield plate 101A for detection of the home position turns ON the home position sensor 101B, the first cams 101 are detected to be in position I, and the first cams 101 are rotated to position II and position III by counting the step number of the first cam motor 123 that may be a stepping motor.

FIG. 4 shows a state of the head pressurizing force adjusting mechanism 100B in position I. In position I, the second spring 106 directly presses the head support member 110 toward the platen 132 and the first springs 105 press the head support-member 110 toward the platen 132 via the head upper/lower arms 104 and a contact member 112.

Accordingly, in position I, the head 131 is strongly pressed to the platen 132 by means of the three springs.

Figure 5:
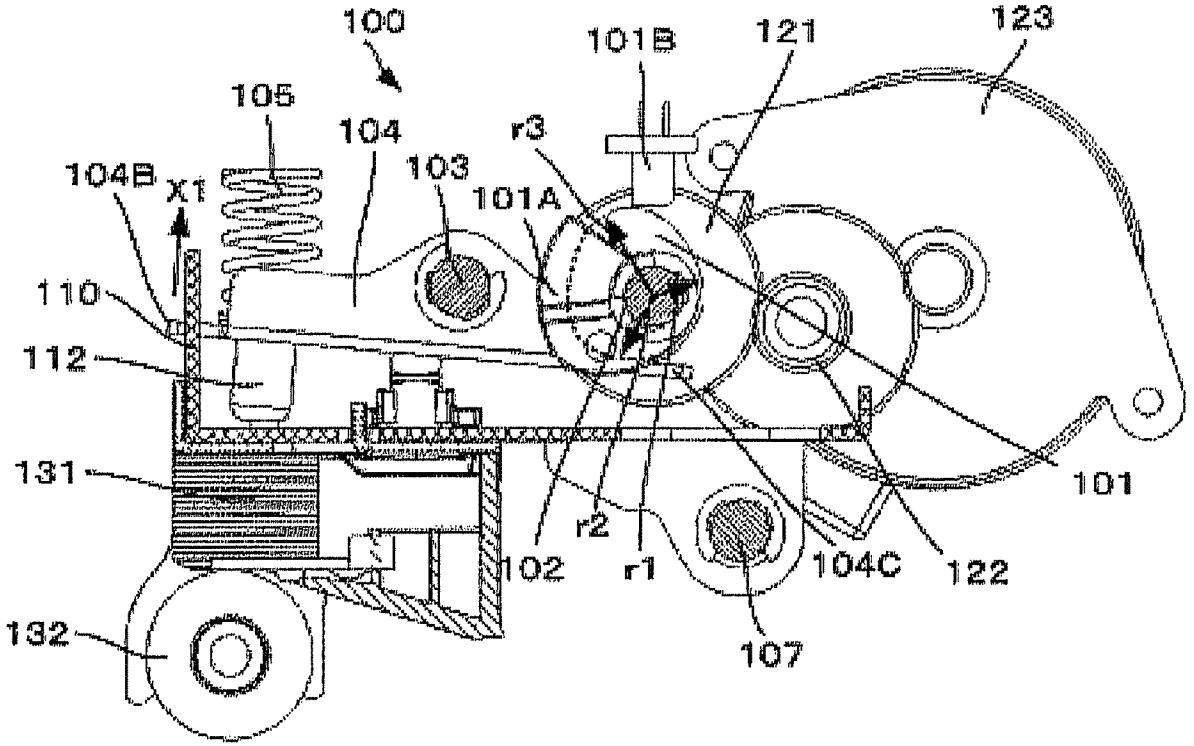
FIG. 5 is a side sectional view of the head pressurizing force adjusting mechanism in position II.

FIG. 5 is a side sectional view of the head pressurizing force adjusting mechanism 100B in position II. As shown in FIG. 5, the first cams 101 push the tailing end 104C of the head upper/lower arms 104 down. When the tailing end 104C is pushed down, the head upper/lower arms 104 rotate around the arm shaft 103 such that the leading end 104B is displaced in a direction X1 to be separated from the platen 132.

When the leading end 104B is displaced in the direction X1, an elastic force of the first springs 105 is not delivered to the head support member 110.

Accordingly, in position II, the head 131 is weakly pressed to the platen 132 only by means of the second spring 106.

Figure 6:
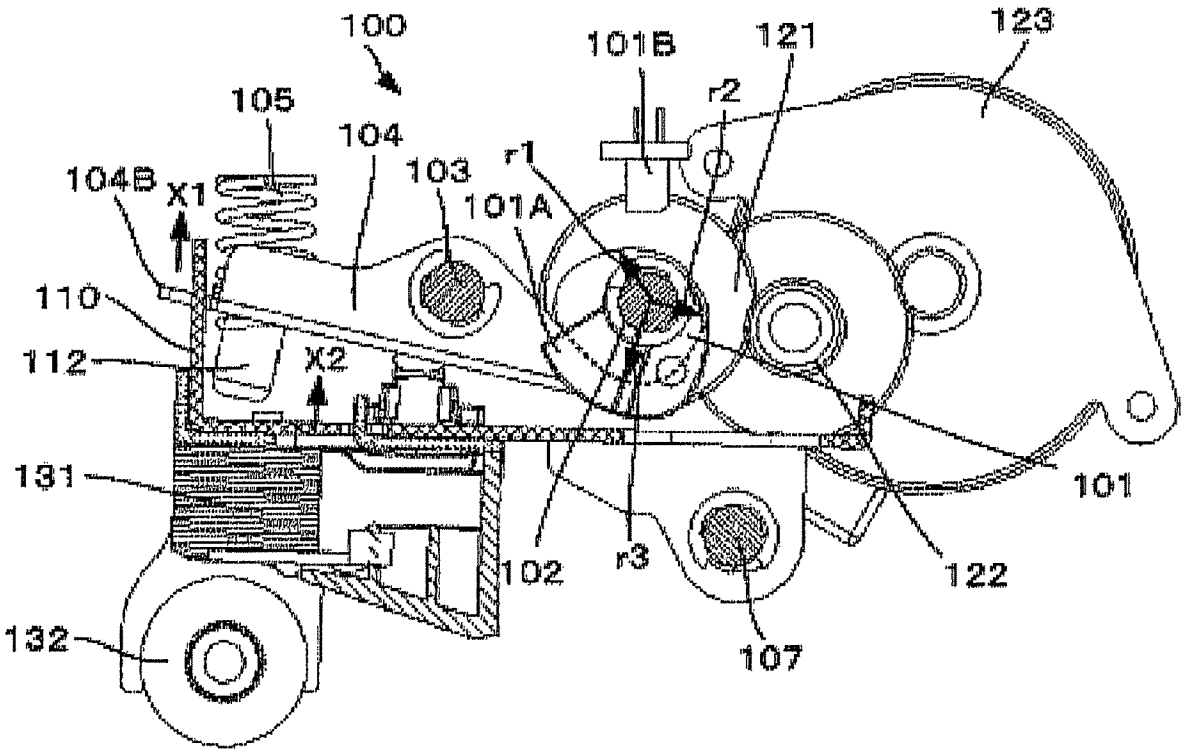
FIG. 6 is a side sectional view of the head pressurizing force adjusting mechanism in position III.

FIG. 6 is a side sectional view of the head pressurizing force adjusting mechanism 100B in position III. As shown in FIG. 6, the first cams 101 further push the tailing end 104C of the head upper/lower arms 104 down. When the tailing end 104C is further pushed down, the head upper/lower arms 104 further rotate around the arm shaft 103 such that the leading end 104B is further displaced in the direction X1 in contact with the top of the opening 111.

When the leading end 104B pushes the top of the opening 111 up, the head support member 110 rotates around the stay shaft 107 in a direction X2.

When the head support member 110 is displaced in the direction X2, an elastic force of the second spring 106 is not delivered to the head support member 110.

Accordingly, the head 131 is separated from the platen 132 in position III.

Figure 7:
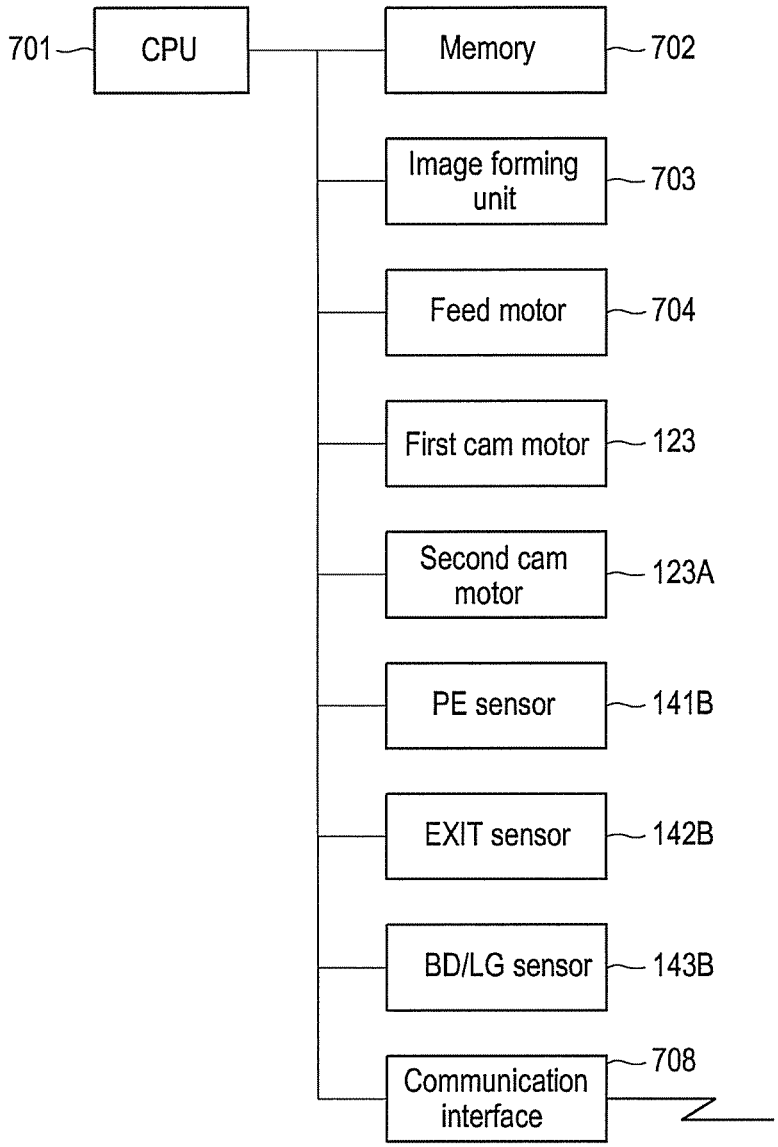
FIG. 7 is a block diagram showing a configuration of the image forming apparatus.

FIG. 7 is a block diagram showing a configuration of the image forming apparatus 1. As shown in FIG. 7, the image forming apparatus 1 includes: a CPU 701 as a control unit; a memory 702 as a storage device; an image forming unit 703 for forming an image; a feed motor 704 for driving the platen 132; the first cam motor 123; a second cam motor 123A; the PE sensor 141B; the BD/LG sensor 143B; the EXIT sensor 142B; and a communication interface 708 for communication with an upper level device such as a host computer.

The CPU 701 receives outputs from the PE sensor 141B, the BD/LG sensor 143B and the EXIT sensor 142B.

The CPU 701 controls operations of the feed motor 704, the first cam motor 123 and the second cam motor 123A based on a combination of input values from the PE sensor 141B, the BD/LG sensor 143B and the EXIT sensor 142B.

Figure 8:
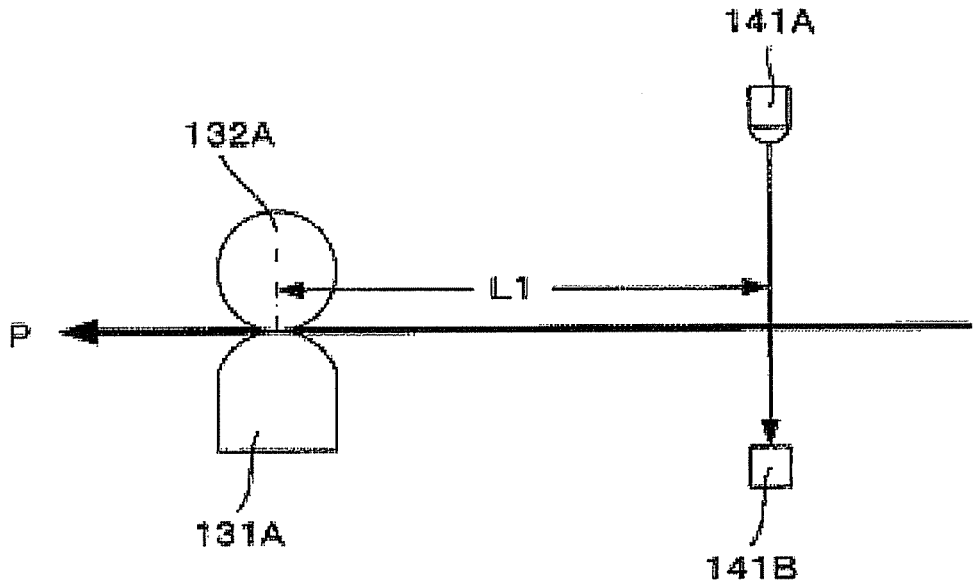
FIG. 8 is a view showing a positional relationship between a second head and a second sensor.

FIG. 8 is a view showing a positional relationship between a second head 131A and a second sensor 141B. As shown in FIG. 8, the second head 131A is located apart by a distance L1 from the PE sensor 141B as the second sensor.

The image forming apparatus 1 adjusts a pressurizing force of the head 131A to a platen 132A in the second printing device 100A and a conveyance speed v of the recording medium 3 based on an output from the sensor 141A, which detects the tailing end of the recording medium 3.

<First Application>

In the image forming apparatus 1, when the PE sensor 141B is turned OFF, i.e., when the tailing end of the recording medium 3 escapes from the PE sensor 141B, the second cam motor 123A is driven to displace the second cam 101A to position III and separate the second head 131A from the second platen 132A.

The recording medium 3 is sandwiched between the head 131 and the platen 132 of the first printing device and is conveyed by rotation of the platen 132.

<Second Application>

In the image forming apparatus 1, when the PE sensor 141B is turned OFF, i.e., when the tailing end of the recording medium 3 escapes from the PE sensor 141B, after a predetermined period of time elapses, the second cam motor 123A is driven to displace the second cam 101A to position III and separate the second head 131A from the second platen 132A.

Here, whether or not the predetermined period of time elapses is determined based on a counted step number of the feed motor 704.

<Third Application>

In the image forming apparatus 1, assuming that the recording medium 3 is conveyed at a speed v, it is taken a time L1/v from when the tailing end of the recording medium 3 escapes from the PE sensor 141B to when it reaches the second head 131A.

In the image forming apparatus 1, when the PE sensor 141B is turned OFF, i.e., when the tailing end of the recording medium 3 escapes from the PE sensor 141B, after a period of time corresponding to a time L1/v elapses, the second cam motor 123A is driven to displace the second cam 101A to position III and separate the second head 131A from the second platen 132A.

Figure 9:
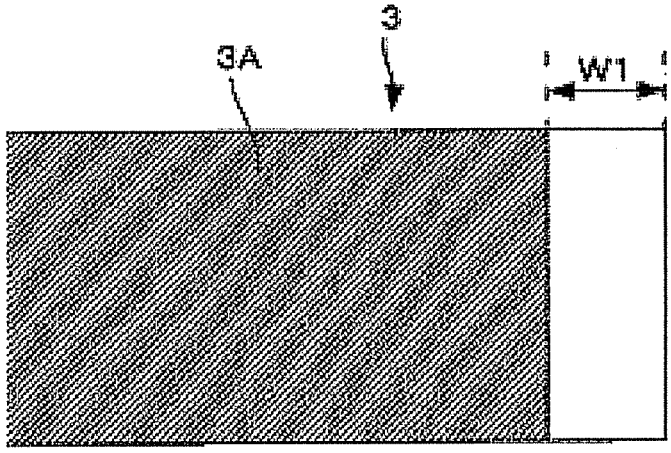
FIG. 9 is a view showing a printing range of a recording medium.

FIG. 9 is a view showing a printing range 3A of the recording medium 3. As shown in FIG. 9, a width of a range in which the image forming apparatus 1 forms no image is referred to as W1.

Additionally, the time taken for the second cam 101A to separate the second head 131A from the second platen 132A is referred to as t.

There is a need to separate the second head 131A from the second platen 132A from when the tailing end of the recording medium 3 escapes from the PE sensor 141B to when it reaches the second head 131A.

Accordingly, the following application is preferably used for the above-described applications.

<Fourth Application>

In the image forming apparatus 1, when the PE sensor 141B is turned OFF, i.e., when the tailing end of the recording medium 3 escapes from the PE sensor 141B, a rotation speed of the feed motor 704 is controlled to decrease the conveyance speed of the recording medium 3.

For example, assuming that a typical conveyance speed is 6 inch/sec, the image forming apparatus 1 decreases the conveyance speed to 3 inch/sec.

<Fifth Application>

In the image forming apparatus 1, when the PE sensor 141B is turned OFF, i.e., in a hiatus of printing after the tailing end of the recording medium 3 escapes from the PE sensor 141B, a rotation speed of the feed motor 704 is controlled to decrease the conveyance speed of the recording medium 3.

Figure 10:
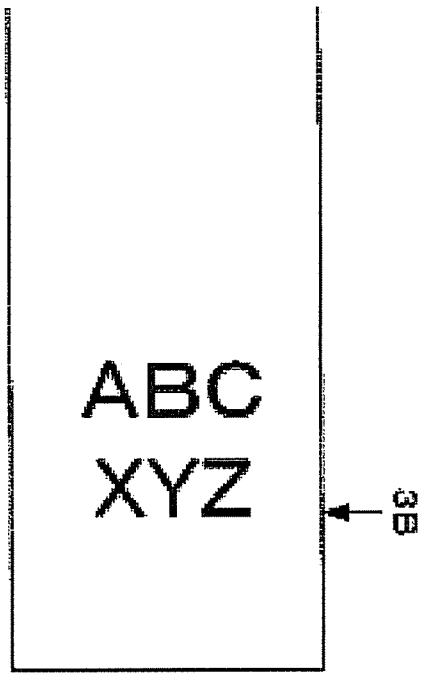
FIG. 10 is a view showing a hiatus of printing.

FIG. 10 is a view showing a hiatus of printing. As shown in FIG. 10, the image forming apparatus 1 decreases the conveyance speed in a hiatus of printing without changing the conveyance speed while performing a printing operation.

<Sixth Application>

The following application may be used for the above-described applications.

Specifically, the image forming apparatus 1 has already detected a length of the recording medium or a position of a leading end of a label. The image forming apparatus 1 calculates a width W1 of a range in which no image is formed by subtracting a length of a printing range from the length of the recording medium. Further, since the time t taken for the second cam 101A to separate the second head 131A from the second platen 132A is constant, the image forming apparatus 1 stores the time t in a storage device in advance.

The image forming apparatus 1 calculates the time taken for the tailing end of the recording medium 3 from when it escapes from the PE sensor 141B to when it reaches the second head 131A according to a formula of W1/v.

The image forming apparatus 1 determines whether or not the time t taken for the second cam 101A to separate the second head 131A from the second platen 132A is longer than the time W1/v taken for the tailing end of the recording medium 3 from when it escapes from the PE sensor 141B to when it reaches the second head 131A.

If it is determined in the image forming apparatus 1 that the time t taken for the second cam 101A to separate the second head 131A from the second platen 132A is longer than the time W1/v taken for the tailing end of the recording medium 3 from when it escapes from the PE sensor 141B to when it reaches the second head 131A, when the PE sensor 141B is turned OFF, i.e., when the tailing end of the recording medium 3 escapes from the PE sensor 141B, a rotation speed of the feed motor 704 is controlled to decrease the conveyance speed of the recording medium 3.

As described above, the image forming apparatus 1 according to this embodiment includes: the first printing device 100 for printing the front surface of the recording medium 3, including the head 131, the platen 132 opposed to the head 131 with the recording medium conveyance path P interposed therebetween, and the head pressurizing force adjusting mechanism 100B for adjusting the pressurizing force of the head 131 to the platen 132; the second printing device 100A disposed upstream in the recording medium conveyance direction of the first printing device 100 and prints the back surface of the recording medium 3, including the head 131A, the platen 132A opposed to the head 131A with the recording medium conveyance path P interposed therebetween, and the head pressurizing force adjusting mechanism 100B for adjusting the pressurizing force of the head 131A to the platen 132A; and the control unit that controls the pressurizing force of the head 131A to the platen 132A in the second printing device 100A and the conveyance speed v of the recording medium 3 based on the output of the second sensor 141A, which detects the tailing end of the recording medium.

Thus, the image forming apparatus has an advantage of avoiding wearing of the head while the tailing end of the recording medium is being printed.

While certain embodiments have been described, these embodiments have been presented by way of example only, and are not intended to limit the scope of the inventions. Indeed, the novel methods and apparatuses described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a first sensor disposed downstream of a recording medium conveyance path and being configured to detect a recording medium;

a second sensor disposed upstream of the recording medium conveyance path and being configured to detect the recording medium;

a first head disposed between the first sensor and the second sensor opposite to a first platen with the recording medium conveyance path interposed between the first head and the first platen, the first head being configured to form an image on a first surface of the recording medium;

a first head pressurizing force adjusting device configured to adjust a pressurizing force of the first head to the first platen;

a second head disposed between the first head and the second sensor opposite to a second platen with the recording medium conveyance path interposed between the second head and the second platen, the second head being configured to form an image on a second surface of the recording medium;

a second head pressurizing force adjusting device configured to adjust a pressurizing force of the second head to the second platen; and a control unit configured to control the second head pressurizing force adjusting device to separate the second head from the second platen if a tailing end of the recording medium escapes from the second sensor.

2. The apparatus of claim 1, wherein the control unit controls the second head pressurizing force adjusting device to separate the second head from the second platen after a predetermined period of time from when the tailing end of the recording medium escapes from the second sensor.

3. The apparatus of claim 1, wherein the control unit controls the second head pressurizing force adjusting device to separate the second head from the second platen from when the tailing end of the recording medium escapes from the second sensor to when the tailing end reaches the second head.

4. The apparatus of claim 1, wherein the control unit controls a conveyance speed of the recording medium to be lower than a typical conveyance speed if the tailing end of the recording medium escapes from the second sensor.

5. The apparatus of claim 4, wherein the control unit controls the conveyance speed of the recording medium to be lower than the typical speed in a hiatus of printing.

6. The apparatus of claim 5, wherein the control unit controls the conveyance speed of the recording medium to be lower than the typical speed if time taken for the second cam to separate the second head from the second platen is longer than time taken for the tailing end of the recording medium from when the tailing end escapes from the second sensor to when the tailing end reaches the second head.

7. The apparatus of claim 6, wherein the first head pressurizing force adjusting device includes:

a first cam having different radiuses;

a first arm making contact with the first cam and rotates with rotation of the first cam;

a first head support member that includes the first head being opposed to the first platen with the recording medium conveyance path interposed between the first head and the first platen, and rotates by the first arm in such a manner that the first head support member contacts the first arm when the first arm rotates by a radius having a first length of the first cam, the first head support member being separated from the first arm as the first arm is displaced in the opposite direction to the first platen when the first arm rotates by a radius having a second length of the first cam, and the first head is separated from the first platen when the first arm rotates by a radius having a third length of the first cam;

a first elastic member that biases the first arm toward the first head support member; and a second elastic member that biases the first head support member toward the first platen, and wherein the second head pressurizing force adjusting device includes:

second cam having different radiuses;

a second arm making contact with the second cam and rotates with rotation of the first cam;

a second head support member that includes the second head being opposed to the second platen with the recording medium conveyance path interposed between the second head and the second platen, and rotates by the second arm in such a manner that the second head support member contacts the second arm when the second arm rotates by a radius having a first length of the second cam, the second head support member being separated from the second arm as the second arm is displaced in the opposite direction to the second platen when the second arm rotates by a radius having a second length of the second cam, and the second head is separated from the second platen when the second arm rotates by a radius having a third length of the second cam;

a first elastic member that biases the second arm toward the second head support member; and a second elastic member that biases the second head support member toward the second platen.

8. A method of adjusting a head pressurizing force, comprising separating a head upstream in a recording medium conveyance direction from a platen being opposed to the head and controlling a conveyance speed of the recording medium to be lower than a typical conveyance speed if a tailing end of a recording medium escapes from a sensor that detects the tailing end of the recording medium.

9. The method of claim 8, wherein the head is separated from the platen after a predetermined period of time from when the tailing end of the recording medium escapes from the sensor.

10. The method of claim 8, wherein the head is separated from the platen from when the tailing end of the recording medium escapes from the sensor to when the tailing end reaches the head.

11. The method of claim 8, wherein the conveyance speed of the recording medium is lower than the typical speed in a hiatus of printing.

12. The method of claim 11, wherein the conveyance speed of the recording medium is lower than the typical speed if time taken to separate the head from the platen is longer than time taken from when the tailing end of the recording medium escapes from the sensor to when the tailing end reaches the head.

* * * * *